United States Patent [19]

Fishburn

[11] Patent Number: 4,798,344

[45] Date of Patent: Jan. 17, 1989

[54] MILL EXHAUST SYSTEM

[75] Inventor: John D. Fishburn, Bloomfield, Conn.

[73] Assignee: Combustion Engineering, Inc., Windsor, Conn.

[21] Appl. No.: 617,000

[22] Filed: Jun. 4, 1984

[51] Int. Cl.[4] ..... B02L 23/32

[52] U.S. Cl. ..... 241/79.1; 241/80; 241/119

[58] Field of Search ..... 241/53, 57, 79, 79.1, 241/80, 97, 117–122, 300

[56] References Cited

U.S. PATENT DOCUMENTS 4,361,290 11/1982 Francis ..... 241/79.1 X 4,505,435 3/1985 Hellewell ..... 241/79.1

*Primary Examiner*—Timothy V. Eley

*Attorney, Agent, or Firm*—Arthur E. Fournier, Jr.

[57] ABSTRACT

A pulverizing mill (10) wherein the pulverized material is classified by a vertical separator (38) as the pulverized material exits the pulverizing mill thus permitting the height of the mill to be reduced.

3 Claims, 1 Drawing Sheet

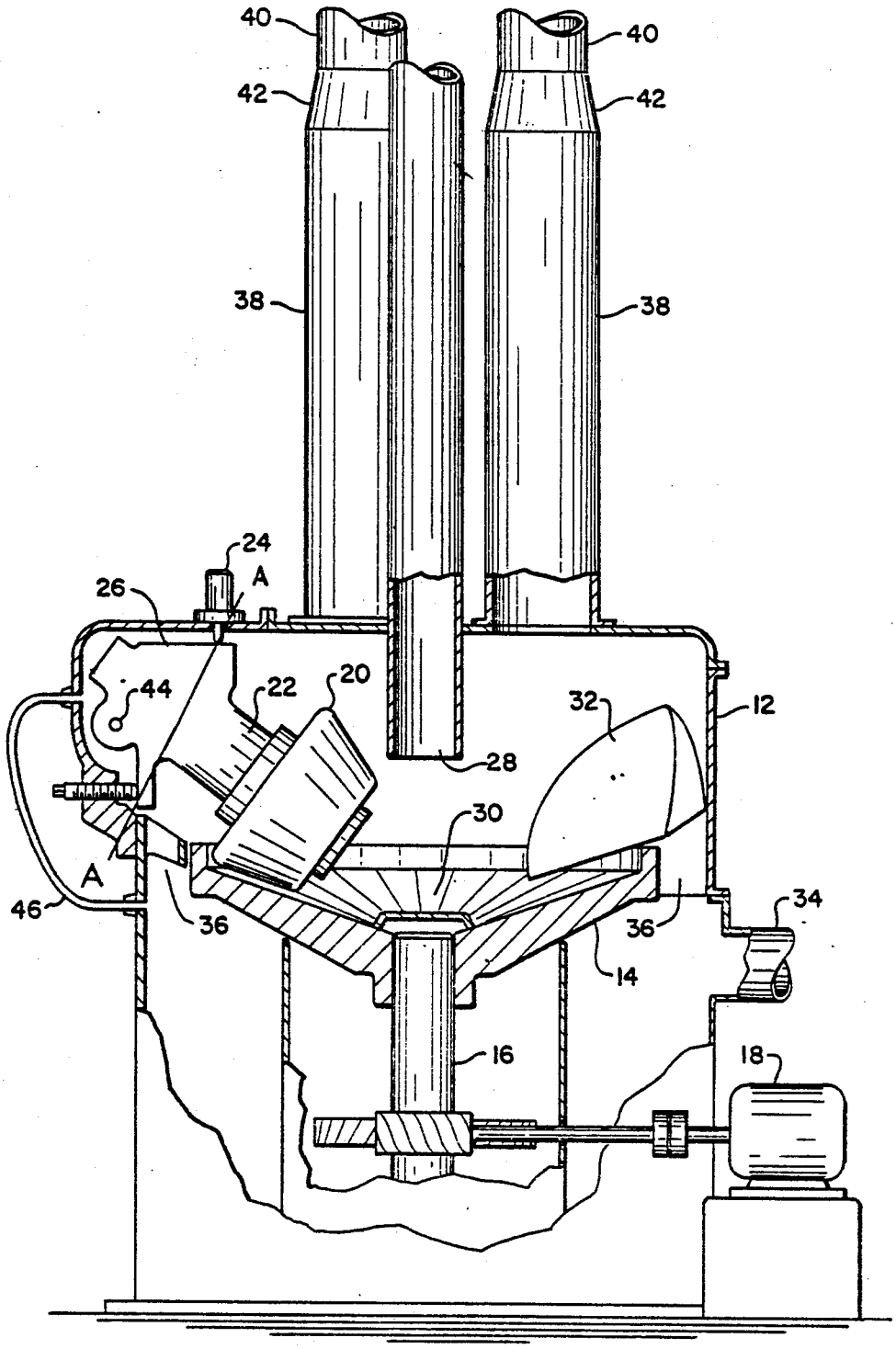
40
40
42
42
38
38
24
A
26
44
22
20
32
12
28
30
A
46
36
36
34
14
16
18

MILL EXHAUST SYSTEM

BACKGROUND OF THE INVENTION

This invention relates to pulverizers and in particular to apparatus for classifying pulverized material that permits reduction in the height of the pulverizer.

Present pulverizers have centrifugal separators in the upper region of the pulverizer within the pulverizer housing between the top of the bowl and the outlet piping. The centrifugal separator is quite large requiring approximately twice the height between the top of the bowl and the outlet piping than would be required without the centrifugal classifier. Material that has been pulverized, typically coal, is entrained in the airflow passing upwardly over the bowl and passes through a plurality of vanes in the upper portion of the centrifugal separator. The vanes impart a circumferential velocity component to the gas flow as it enters the centrifugal separator. The heavier pulverized material is separated from the gas flow by the centrifugal separator and is returned to the bowl through an inverted conical lower portion of the centrifugal separator to be pulverized again. The finer pulverized particles remain entrained in the airflow and pass through the centrifugal separator to the outlet piping. In this manner prior art pulverizers classify pulverized material in a centrifugal separator that is within the pulverizer housing with the circumferential velocity component required to accomplish centrifugal separation imparted by the vanes adjustable by varying the angle of the vanes relative to the centrifugal separator.

As pulverizers of larger capacity and hence larger physical size are developed, the overall height of the pulverizer must be limited. It is an object of this invention to provide apparatus for classifying material pulverized in a pulverizer that permits a reduction in the height of the pulverizer while maintaining the ability to control the size of the pulverized particulate matter exiting the pulverizer through the classifying apparatus.

SUMMARY OF THE INVENTION

In accordance with the present invention, at least one vertical separator extending upwardly from the top of the pulverizer housing is used to classify the pulverized material entrained in the airflow exiting the pulverizer. Each vertical separator is substantially cylindrical of a length and diameter relative to the nominal airflow therethrough to classify the pulverized material entrained in the airflow. Each vertical gravity separator terminates in a reduced section of wear resistant material with the outlet of the reduced section compatible with a transport pipe that delivers the classified pulverized material entrained in the airflow to a process. Employing a vertical gravity separator to classify pulverized material entrained in the airflow exiting the pulverizer permits a reduction in the height of the pulverizer housing.

BRIEF DESCRIPTION OF THE DRAWING

The FIGURE is a side view, partially in section, of a pulverizer in accordance with the present invention.

DESCRIPTION OF THE PREFERRED EMBODIMENT

Referring to the drawing, there is depicted therein a pulverizer 10 for pulverizing material and classifying the pulverized material in accordance with the present invention. Pulverizer 10 is comprised of housing 12 within which rotatable bowl 14 is mounted on shaft 16. Shaft 16 and attached bowl 12 are rotated by drive 18. At least one grinding element, roller 20, is rotatably mounted on shaft 22. Typically, there are three rollers 20 equidistantly spaced around rotatable bowl 14. Pressure supplied by pressure means 24 against journal 26 urges roller 20 towards the inner surface of rotatable bowl 14 thereby pulverizing the material passing therebetween as rotatable bowl 14 rotates beneath rollers 20. Roller 20 and journal 26 are pivotally mounted on shaft 22 so that roller 20 can move towards and away from bowl 14 depending upon the depth of the material being pulverized thereon.

Material to be pulverized, typically coal, is introduced into pulverizer 10 through inlet 28. The coal is deposited near the center of the upper surface of bowl 14 on a conical section 30 that promotes the coal moving radially outward from the center of bowl 14 as bowl 14 rotates. The coal passes under plow 32 before passing between roller 20 and the upper surface of bowl 14. Plow 32 limits the depth of the bed of coal being pulverized; roller 20 can move towards and away from bowl 14 as the depth of the bed of coal varies.

Heated air for drying and transporting the pulverized coal enters housing 12 beneath bowl 14 at an inlet 34. The air passes upwardly through housing 12 around bowl 14 through annular space 36 entraining pulverized coal and conveying the entrained pulverized coal to vertical separators 38 thence to transport lines 40. The larger particles of insufficiently ground coal fall back onto the top surface of bowl 14 before reaching vertical separator 38 where they are further ground. The finer particles are carried along by the airstream into vertical separators 38.

In accordance with the present invention, vertical separators 38 extend vertically upward from the top of housing 12 and further classify the pulverized coal entrained in the airstream passing therethrough. The vertical separators are substantially vertical and designed with a cross-sectional area and length relative to a nominal airflow therethrough to classify the pulverized coal such that only pulverized coal of an acceptable fineness passes beyond vertical separators 38 into transport lines 40. Vertical separators 38 terminate in transport lines 40 with a reducing section 42 therebetween prior to any turns.

The lower portion of vertical separators 38 are of greater inside diameter than the inside diameter of transport lines 40. In the lower portion of vertical separator 38 a portion of the pulverized coal entrained in the airstream consists of particles too heavy to be supported by the upward flowing airstream. These heavier coal particles fall back onto rotatable bowl 14 for further grinding. In moving along vertical separator 38 away from housing 12 fewer and fewer heavy particles of coal are entrained in the airstream. In this manner, vertical separators 38 classify the pulverized coal such that the pulverized coal entrained in the airstream at the top of vertical separator 38 in the region of reducing section 42 is of an acceptable size for the process.

Reducing sections 42 have an inlet inside diameter equal to the inside diameter of the lower portion of vertical separators 38 and an outlet inside diameter equal to the inside diameter of transport lines 40. Reducing sections 42 are fabricated of a wear resistant material such as nihard and accelerate the flow of pulverized coal entrained in air to avoid separation of the pulverized coal in transport lines 40. Vertical separators 38 are sized to classify pulverized coal based on a nominal airflow therethrough. In the preferred embodiment, vertical separators 38 are substantially cylindrical with a length, from pulverizing mill housing 12 to reducing section 42 inlet, to diameter ratio of at least 5 to 1. This relationship assures that vertical separator 38 further classifies the coal entrained in the airflow passing therethrough such that as the pulverized coal entrained airstream passes upwardly through vertical separator 38 plug flow is created prior to reducing section 42. Plug flow exists when the upward velocity of the airstream through vertical separator 38 is uniform across the separator and at least as great as the entrainment velocity of all pulverized coal entrained in the airstream. Thus, when plug flow exists the pulverized coal entrained in the airstream moves uniformly upward with the airstream with no additional pulverized coal falling back toward bowl 14 for regrinding.

Although vertical separator 38 is initially designed to classify pulverized coal to a desired fineness based on a nominal airflow through the separator, once in operation the fineness of the pulverized coal passing through vertical separators 38 can be fine tuned by varying the airflow through pulverizer 10. By decreasing the airflow through pulverizer 10, the entrainment velocity in the upper region of vertical separator 38 is decreased thereby increasing the fineness of pulverized coal particles passing from vertical separator 38 to transport lines 40. Conversely, increasing the airflow through pulverizer 10 would increase the entrainment velocity in vertical separator 38 thereby decreasing the fineness of pulverized coal particles passing from vertical separator 38 to transport lines 40.

A portion of the air supplied to pulverizer 10 through air inlet 34 may be used to purge housing 12 in the region containing the main roller support bearing 44 on which journal 26, shaft 22 and roller 20 pivot. Purging housing 12 in the region of main roller support bearing 44 of pulverized coal extends the life of bearing 44 and is particularly effective when the clearance between journal 26 and housing 12 in the region shown by line A—A is minimized. The air required to purge housing 12 in the region of bearing 44 may be taken directly from air inlet 34 or from a region within housing 12 that is relatively free of pulverized coal. Line 46 is shown bleeding an airstream from beneath bowl 14 to purge the interior of housing 12 in the region of bearing 44.

Although the preferred embodiment is described with respect to pulverizing coal, the invention is not limited thereto. Furthermore, although the preferred embodiment of the vertical separator has been described as having a length to diameter ratio of at least 5 to 1, the cross-section of the vertical separator is not limited to being circular. A length to cross-sectional area ratio, when the cross-section is not circular, substantially equivalent to a length to diameter ratio of at least 5 to 1, when the cross-section is circular, is contemplated as within the scope of the invention.

What is claimed is:

1. A pulverizing mill for pulverizing material and for delivering the pulverized material to a process through a transport line comprising:

a housing;

a rotatable bowl within the housing, said bowl having an upper surface;

means for rotating the bowl;

means for depositing material to be pulverized on the upper surface of the bowl;

a grinding roll supported within the housing cooperating with the upper surface of the bowl to perform pulverizing therebetween;

means for supplying air to the housing for entraining pulverized material therein; and a vertical gravity separator means for classifying the pulverized material and for returning the more coarse pulverized material to the surface of the bowl, the vertical separator means comprising:

a substantially cylindrical conduit extending upwardly from the top of the housing defining a flow passage duct for conducting the pulverized material entrained in air from the housing, the passage duct having a greater cross-sectional area than the transport line and being of a length and cross-sectional area relative to the airflow therethrough to classify the pulverized material entrained in the airflow, the length to diameter ratio of the conduit being at least 5 to 1, and a reduced section between the conduit and the transport line having an inlet and an outlet, the inlet having the same cross-sectional area as the conduit and the outlet having the same cross-sectional area as the transport line, whereby the finer pulverized particles entrained in the airflow entering the conduit pass into the transport line thence to the process.

2. The pulverizing mill as recited in claim 1 wherein the reduced section is comprised of an abrasion resistant material.

3. The pulverizing mill as recited in claim 1 wherein the means for supplying air to the housing further comprises means for continuously supplying a portion of the air to the housing in the region of the grinding roll support whereby the region of grinding roll support is continuously purged of pulverized material.

* * * * *